US007700872B2

(12) United States Patent
Allen et al.

(10) Patent No.: US 7,700,872 B2
(45) Date of Patent: Apr. 20, 2010

(54) CABLE FOR STRINGED MUSICAL INSTRUMENTS

(75) Inventors: John C Allen, Lincoln University, PA (US); Edward Neitzel, Elkton, MD (US); Craig Theorin, Landenberg, PA (US)

(73) Assignee: Gore Enterprise Holdings, Inc., Newark, DE (US)

( * ) Notice: Subject to any disclaimer, the term of this patent is extended or adjusted under 35 U.S.C. 154(b) by 0 days.

(21) Appl. No.: 12/392,494

(22) Filed: Feb. 25, 2009

(65) Prior Publication Data

US 2009/0200058 A1 Aug. 13, 2009

Related U.S. Application Data

(63) Continuation of application No. 12/028,923, filed on Feb. 11, 2008, now abandoned.

(60) Provisional application No. 60/889,347, filed on Feb. 12, 2007.

(51) Int. Cl.
*H01B 7/00* (2006.01)

(52) U.S. Cl. ..... 174/28; 174/102 R; 174/102 A

(58) Field of Classification Search ..... 174/28, 174/36, 102 R, 103, 106 R
See application file for complete search history.

(56) References Cited

U.S. PATENT DOCUMENTS 3,433,687 A * 3/1969 Price ..... 156/47
4,638,114 A 1/1987 Mori ..... 174/36
4,691,081 A * 9/1987 Gupta et al. ..... 174/105 R
4,701,576 A * 10/1987 Wada et al. ..... 174/117 F
5,008,489 A * 4/1991 Weeks et al. ..... 174/36
5,262,591 A * 11/1993 Aldissi ..... 174/36
5,477,011 A * 12/1995 Singles et al. ..... 174/102 R
6,479,753 B2 * 11/2002 Borg et al. ..... 174/113 R

FOREIGN PATENT DOCUMENTS

DE 33 32 905 9/1984
JP 2005 122937 5/2005

OTHER PUBLICATIONS www.procosound.com "Cable Anatomy I: Understanding The Instrument Cable", written by Scott Brunham, 1986-87.

* cited by examiner

*Primary Examiner*—William H Mayo, III
(74) *Attorney, Agent, or Firm*—Allan M. Wheatcraft

(57) ABSTRACT

A center conductor having an effective outer diameter; a dielectric material around the center conductor, a semi-conductive layer around the dielectric material, an outer conductor, or shield, around the dielectric material; the shield having an effective inner diameter; wherein the center conductor has a cross-sectional area of $3.141\times10^{-4}$ in$^2$ or less; wherein the cable has a capacitance of about 15 pF/ft or less; wherein the cable maintains electrical continuity under a tensile force of 25 lbf or greater; wherein the cable has a flex life of greater than about 30,000 cycles; and wherein the cable is a musical instrument cable.

28 Claims, 4 Drawing Sheets

Circuit Model of Guitar Pickup, Cable and Amplifier

Simulated and Measured Frequency Response of Passive System per Cable Capacitance Braided Construction Parameters Flex Test Setup

CABLE FOR STRINGED MUSICAL INSTRUMENTS

CROSS REFERENCE TO RELATED APPLICATION

The present application is a continuation application of U.S. patent application Ser. No. 12/028,923 filed Feb. 11, 2008 now abandoned; and U.S. Provisional Application No. 60/889,347 filed on Feb. 12, 2007.

FIELD OF THE INVENTION

This invention relates to an improved cable for stringed musical instruments, and more particularly, to an improved cable for stringed musical instruments with low capacitance.

BACKGROUND OF THE INVENTION

Guitars and other stringed instruments are often amplified by attaching a passive magnetic pickup in close proximity to the vibrating metallic strings and connecting this pickup to an amplifier and speaker using a cable. The vibrating string changes the magnetic flux within the core of the pickup. This flux change induces a voltage change in the outer coils of the pickup, thus completing the translation of mechanical vibration to electrical signal. This signal is transmitted through the cable to the amplifier.

The cable connecting the pickup to the amplifier is typically between 5 and 30 feet in length to allow the musician adequate mobility while playing. For increased mobility, some musicians use wireless transmitters which allow substantially greater distances between the guitar and amplifier, however, the vast majority of musicians don't require the additional distance and prefer to use the less expensive cable connection.

In addition to the electrical requirements of a guitar cable, the guitar cable must have a combination of mechanical attributes. Guitar cables need to withstand tensile forces when extracting them from the jacks in guitars and amplifiers. Cables require adequate flexibility to not inhibit movement by the player and need to be robust enough to endure the random flexing exerted by players through constant movement. They also need to withstand the forces of coiling and uncoiling associated with storage when not in use.

Coaxial cable, where the signal is surrounded by a 360 degree metallic wire shield, is the most common connection between the electric guitar and the amplifier. The coaxial structure offers several advantages over other cable designs. The outer shield protects the low voltage signals traveling inside the cable's core from radio frequency interference (RFI) which is important since the guitar signal, along with any RFI noise, is significantly amplified prior to the speaker. The coax structure offers the minimum size for a shielded cable for a given capacitance. The round structure allows for maximum flexibility in all directions. This is important during use as well as when winding the cable up for storage.

Electrical models have been created for the circuit of a passive guitar pickup connected to an amplifier using a cable (see for example the Instruction Manual for the Lemme Pickup Analyzer). The circuit shown in FIG. 1 is modeled as a pickup, cable and amplifier. The cable, when used for audio frequencies at lengths up to 500 feet can be viewed as a series resistor, equivalent to the total resistance of the signal path, and a parallel capacitor, whose value equals the lumped capacitance of the signal path. The amplifier input circuit is very high impedance, typically 500,000 Ohms to 1,000,000

Ohms. Given the voltage divider circuit between the cable resistance and amplifier input resistance, the signal transmission of the circuit is relatively insensitive to cable resistance below 50-100 ohms. Instrument cables have resistance values well below this range.

The frequency response of the circuit is dependent on the interaction of the pickup inductance and cable capacitance. A resonant frequency is created where the reactance of the cable capacitance and pickup inductance are equivalent in amplitude. The resonant frequency of the circuit in FIG. 1 is calculated by:

$$f_r = \frac{1}{2\pi\sqrt{LC}}$$

Where L is the fixed pickup inductance and C is the lumped cable capacitance, which is determined by the cable design and length. The resonant frequency is inversely proportional to cable capacitance. As cable capacitance is decreased the resonant frequency is increased.

Using a Lemme Pickup Analyzer the response of a 2005 Fender American Series Stratocaster bridge pickup was measured in series with various lengths of cable to achieve desired capacitance values (see FIG. 2). The response curves were also simulated using SPICE software.

The circuit simulation along with measurements in FIG. 2 also show that the amplitude of the resonant frequency is decreased as the cable capacitance is decreased creating a flatter response in the guitar's midrange frequencies. The −3 dB roll-off frequency of the circuit response is also proportional to the cable capacitance. For a given pickup inductance, as the cable capacitance decreases, the −3 dB roll-off frequency will increase. This allows a wider range of audio frequencies to be transmitted and heard.

Shifts towards a wider range of audio frequencies above −3 dB, and a less emphasized resonant frequency, are readily perceived by guitar players as tonal shifts towards increased clarity and brightness. For a guitarist that would like this effect using an instrument with a passive magnetic pickup, it is necessary to minimize cable capacitance.

The coaxial cable capacitance (C) in picofarads per foot (pF/ft) is given by:

Equation 1: Coaxial Cable Capacitance $$C = \frac{7.36\varepsilon_r}{\log\left(\frac{D_e}{d_e}\right)}$$

Where:

$\in_r$=Relative dielectric constant $D_e$=Effective inner diameter of the outer shield $d_e$=Effective outer diameter of the center conductor The effective diameter is the electrical equivalent diameter of multiple conductor geometry. It takes into account the gaps between wires in specific constructions.

The effective diameters (De) of shields are calculated by:

$D_e$=D, for a round tube or foil wrap $D_e=D+1.5d_w$, for a braided shield $D_e=D+0.8d_w$, for a served shield Where:

D=the geometrical outer diameter of an insulation component contacting the inner diameter of a shield construction $d_w$=geometrical diameter of shield component wire The effective diameters ($d_e$) of concentric stranded center conductors are calculated using:

$d_e$=d, for a single wire $d_e$=2.84d, for n=7

$d_e$=3.99d, for n=12

$d_e$=4.90d, for n=19

$d_e$=6.86d, for n=37

Where:

d=geometrical diameter of a center conductor component wire n=number of component wires While there are several ways to reduce cable capacitance, each has a distinct disadvantage:

Reducing the relative dielectric constant of the material between the center conductor and shield: Several inexpensive materials, such as polyethylene, can have gas injected into them during processing to reduce the dielectric constant to approximately 1.5. To achieve dielectric constants below this requires more expensive processes and lower dielectric materials such as fluoropolymers.

Increasing the effective inner diameter of the outer shield: This option is bounded by the cost of adding material and the practical limits of the cable diameter that will fit into connector sizes.

Reducing the effective outer diameter of the center conductor: Typical commercially available cables use 18-22 AWG copper center conductors. This range of wire gage represents conductors with an outer diameter ranging from approximately 0.0500 to 0.0253 inches respectively. The conductor can be a solid conductor or multiple conductors to achieve the proper size. Some multiple conductor examples can be found down to 26 AWG copper, which has an outer diameter of approximately 0.0200 inches. Component wire diameters (d) in these multiple configurations can be found down to 0.002 inches. To reduce the effective diameter of the center conductor, the component wire (d) and number of strands should be decreased as shown under Equation 1. As the component wire diameter (d) and number of strands is decreased, the total cross-sectional area of the center conductor wires is decreased. A smaller cross-sectional area results in a lower tensile force at failure for a given material. This compromises both flex life and tensile strength of the cable.

What is needed to improve signal fidelity of instrument cables is a cable that has low capacitance while maintaining strength, durability, connector compatibility, and cost effectiveness.

SUMMARY OF INVENTION

The present invention provides cable with a center conductor having an effective outer diameter; a dielectric material around the center conductor, a semi-conductive layer around the dielectric material an outer conductor, or shield, around the dielectric material; the shield having an effective inner diameter; wherein the center conductor has a cross-sectional area of $3.141\times10^{-4}$ in$^2$ or less; wherein the cable has a capacitance of about 15 pF/ft or less; wherein the cable maintains electrical continuity under a tensile force of 25 lbf or greater; wherein the cable has a flex life of greater than about 30,000 cycles; and wherein the cable is a musical instrument cable. Preferably, the center conductor has a cross-sectional area of $1.767\times10^{-4}$ in$^2$ or less, and comprises copper with a tensile strengths greater than about 35 ksi. More preferably, the center conductor comprises an alloy, which is preferably an alloy of beryllium and copper. The center conductor preferably has a reinforcement layer around it, preferably made of expanded polytetrafluoroethylene (ePTFE). Alternatively, the reinforcement layer comprises fluoropolymers, thermosetting or thermoplastic polymers, cellulose-based materials or metallic foils.

Also preferably, the shield is a braid where the strands are at an angle less than 40 degrees from the axis of the braid. A ratio of the shield effective inner diameter to the center conductor effective outer diameter is greater than about 8, preferably greater than about 10, and most preferably greater than about 12. The capacitance is preferably about 12 pF/ft or less, and more preferably about 10 pF/ft or less. The cable maintains electrical continuity under a tensile force of about 50 lbf or greater and under a tensile force of about 100 lbf or greater. Preferably, the flex life is greater than about 150,000 cycles, and more preferably, about 275,000 cycles. The musical instrument is preferably a stringed instrument that incorporates a passive magnetic pickup.

In another aspect, the invention provides an article comprising the inventive cable in combination with a stringed instrument that incorporates a passive magnetic pick-up.

DETAILED DESCRIPTION OF THE INVENTION

1. Description of the Preferred Embodiments

Figure 7:
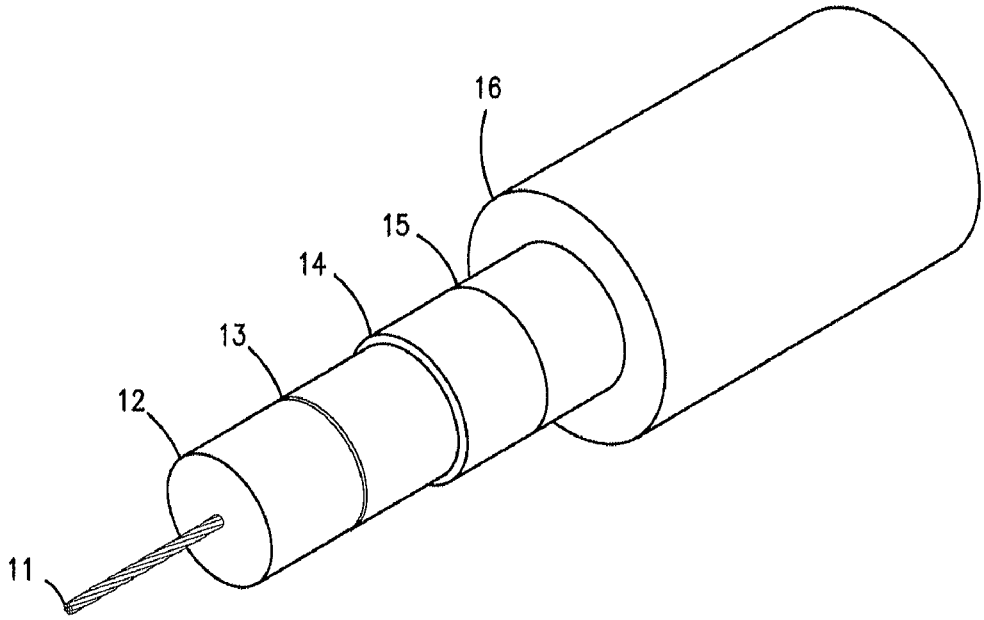
FIG. 7 is a perspective drawing of one embodiment of the present invention.

The present invention will now be described in connection with the preferred embodiment illustrated in FIG. 7. As shown in FIG. 7, the inventive instrument cable comprises a center conductor 11, dielectric 12, semi-conductive layer 13, shield 14, optional binder 15, and jacket 16.

Dielectric 12 around center conductor 11 is preferably foamed polyethylene. As discussed above, minimizing the effective outer diameter of center conductor 11 reduces capacitance. Although it might alternatively be possible to use a larger center conductor 11 and reduce capacitance by increasing the effective inner diameter of the shield 14, such a solution is not practical with an instrument cable which has specific requirements for the ultimate cable outer diameter (preferably less than 0.375 inches). Accordingly, applicants have discovered that in conjunction with reducing the effective outer diameter of center conductor 11, it is necessary to ensure that the ratio of the effective inner diameter of the shield 14 to the effective outer diameter of center conductor 11 is greater than about 8.

Because of the necessity to reduce charge buildup between dielectric 12 and outer shield 14, a semi-conductive layer 13 is preferably disposed between dielectric 12 and shield 14. Semi-conductive layer 13 is preferably formed of a semi-conductive solid polyethylene and serves to minimize the triboelectric effect and associated electrical noise produced as shield 14 moves in relation to dielectric 12.

A jacket 16, preferably PVC with TPE additive is disposed around shield 14. A binder 15 is optionally disposed between jacket 16 and shield 14. If used, binder 15, is preferably made of 0.002 inch thick ePTFE. Alternatively, materials such as fluoropolymers, thermosetting or thermoplastic polymers, cellulose-based materials, or metallic foils can also be used as the binder 15 in this construction.

Figure 8:
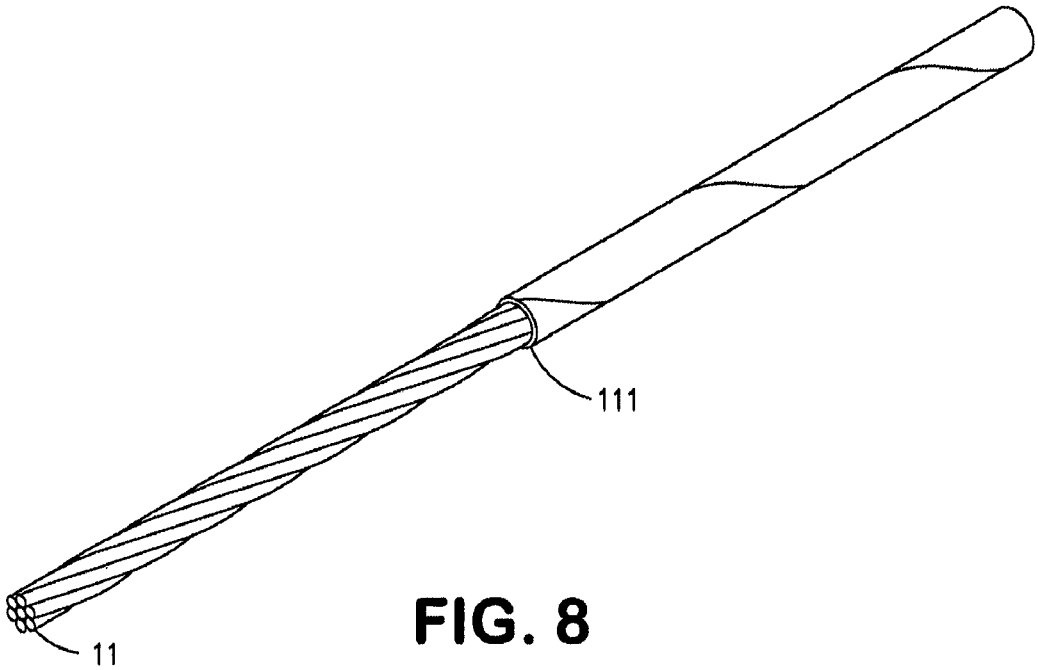
FIG. 8 is a perspective drawing of a tape reinforced center conductor.

Center conductor 11 in the preferred embodiment is an alloy of beryllium and copper. Such an alloy wire is available from IWG High Performance Conductors, Inc. An alloy is preferred for center conductor 11 because alloys typically have better tensile strength and flex life than non-alloys, as illustrated in the examples below. Other copper alloys may be used in the present invention as will be recognized by those skilled in the art. In a further alternative embodiment, center conductor 11 is reinforced with a wrapped expanded PTFE (ePTFE) tape 111 as shown in FIG. 8. With this alternative embodiment, as illustrated in the examples below, the tensile strength and flex life of the center conductor 11 is maximized. Because reinforcing center conductor 11 with an ePTFE tape so greatly enhances the tensile strength and flex life, it is also contemplated as a further alternative of the embodiment to use a copper center conductor, rather than an alloy, in combination with the ePTFE tape wrap for center conductor 11. Alternatively, materials such as fluoropolymers, thermosetting or thermoplastic polymers, cellulose-based materials, or metallic foils, can also be used as the reinforcement in this construction.

In order to minimize capacitance, and thereby increase the clarity and brightness of the audio signal, the relative dielectric constant of dielectric 12 should be low. A dielectric constant less than 2.0 is preferred, and a constant of less than 1.5 is most preferred. The ratio of the shield effective inner diameter ($D_e$) to center conductor effective outer diameter ($d_e$) also can be increased to minimize capacitance.

An effective diameter ratio greater than 8 is preferred, and a ratio of 12 is most preferred. A shield effective inner diameter of greater than 0.120 inches is preferred and an effective diameter of greater than 0.160 inches is most preferred. The center conductor 11 is preferably made of a very small wire to achieve low capacitance while maintaining an acceptable shield diameter.

For center conductors with only one wire, the effective diameter is the same as the geometrical diameter of the conductor (See equation 1). However, single conductors do not perform as well in flexure. The center conductor is preferably made of multiple conductors to improve flexibility. A center conductor effective outer diameter of less than 0.020 inches is preferred, and a diameter of 0.015 inches is most preferred. Since a total geometrical diameter of multiple conductors is difficult to measure, the total cross-sectional area is used to define the center conductor. It is also a useful value in determining tensile strength. A center conductor with total cross-sectional area of less than $3.141\times10^{-4}$ in$^2$ is preferred, and an area of less than $1.767\times10^{-4}$ in$^2$ is most preferred. Using such a fine center conductor 11 in combination with the low dielectric material and effective diameter ratio provides the low capacitance required for the optimum performance of instrument cable 10. Preferably, as illustrated in the examples below, the cable capacitance is less than 15 pF/ft, and most preferably about 10 pF/ft. Because minimizing the center conductor 11 size has the collateral effect of weakening center conductor 11, applicants have discovered that the decrease in mechanical properties can be solved by either using an alloy for center conductor 11, wrapping semi-conductor 11 with an ePTFE tape, or both. In addition, as discussed below, applicants have discovered further cable strength-enhancing features that produce the inventive instrument cable 10.

Applicants have discovered that certain center conductor constructions produce surprisingly good tensile strength and flex life performance results. The tests, results, and conclusions are presented in the Examples section below.

Figure 1:
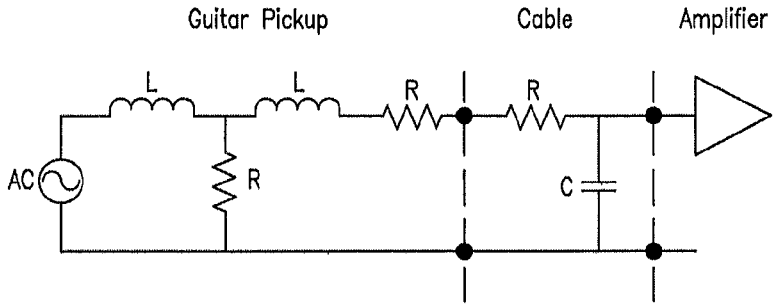
FIG. 1 is a schematic circuit model of a passive guitar pickup, cable, and amplifier.
Figure 2:
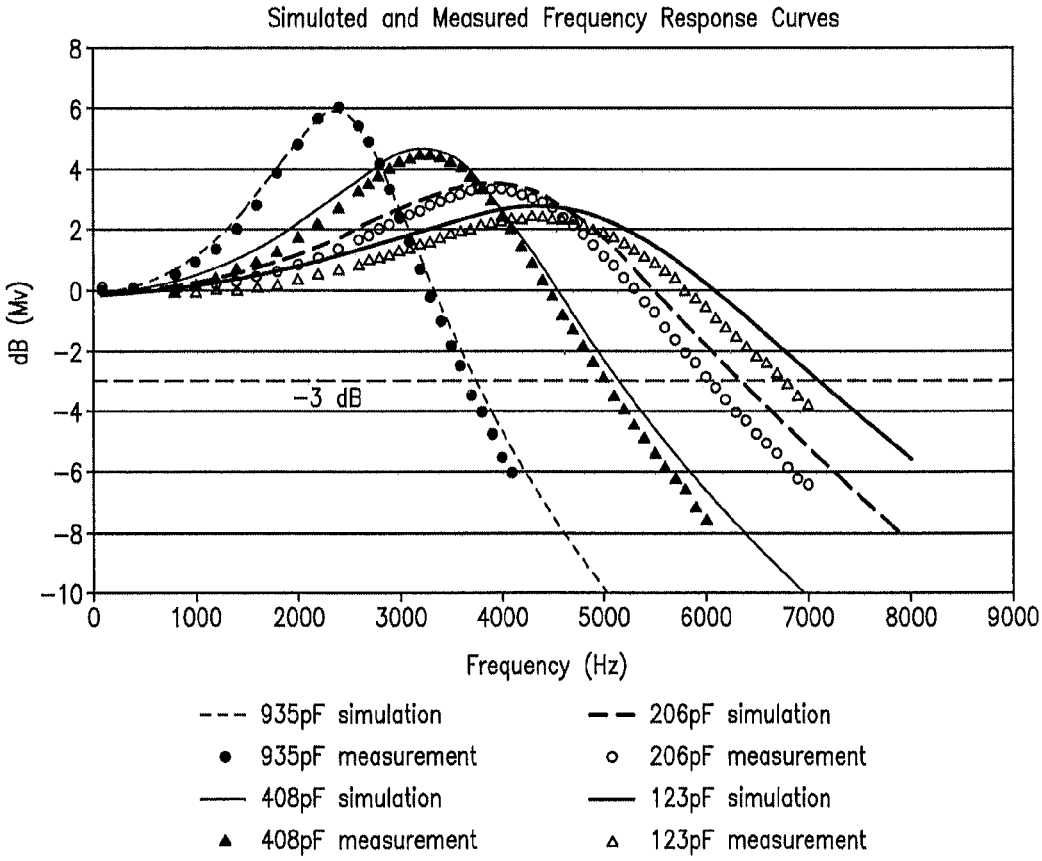
FIG. 2 is a graph of simulated and measured frequency response of a passive system per cable capacitance.
Figure 3:
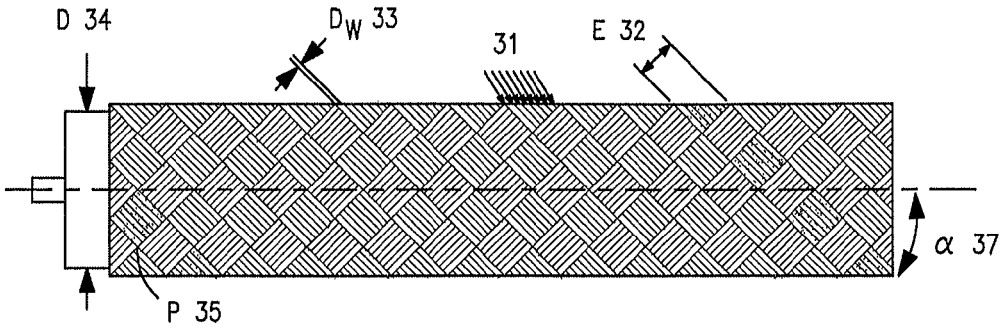
FIG. 3 is a schematic side view of a braided shield according to an exemplary embodiment of the present invention.

Referring back to FIG. 7, shield 14 is disposed around dielectric 12. Shield 14 is preferably a braided construction, shown in FIG. 3, having a geometrical inner diameter (at the point where the braid contacts the outer diameter of an insulation component) "D" (34) of about 0.165 inches, comprised of 38 AWG-copper strands measuring about 0.004 inches in diameter "$d_w$" (33) braided with 24 carriers _"E"_(32) with 8 ends (or "wires" (31)) per carrier "E" (32), with a braid angle "α" (37) of approximately 22 degrees in the illustrated embodiment. The point "P" (35) at which braid wires from one carrier cross another is called a "pick." The preferred number of picks per inch is about 9.

Applicants have discovered that shield 14 is preferably a braided construction that supports the center conductor and maximizes the tensile strength of instrument cable 10. The preferred braid angle "α" (37) for the shield 14 is less than 40 degrees from the longitudinal axis of the cable. Additionally, at any braid angle or shield construction (e.g., serve wire shield), alternative strength members, such as polymer tapes, metal foils, and fibers, may be incorporated to reinforce the center conductor. The fiber may be one or multiple parts of a multi-conductor configuration. Additionally, the fiber may run parallel to the longitudinal axis of the cable.

The braid angle is calculated according to the following Equation 2:

Equation 2: Braid Angle $$\alpha = \tan^{-1}\left(\frac{2Q\pi D_{ave}}{m}\right)$$

Where:

α=braid angle (37)

Q=number of picks "P" (35) per inch m=number of carriers (32)

$D_{ave}$=average braid diameter calculated by:

$$D_{ave}=D(34)+2d_w(33)$$

Changing the braid parameters for a given cable construction will alter how the cable behaves under tensile stress. Modifying braid parameters will determine how well the cable's composite structure protects the center conductor from high tensile stresses and ultimately failure. Adding braid metal by increasing the diameter of the braid strands or increasing the total number of wires in the braid will improve the overall strength of the cable. Other strength enhancing components will also improve the overall strength of the cable. However, the a small center conductor can break before this ultimate strength is realized. In combination with strength, the tensile stiffness of the cable needs to be high enough to protect the smaller center conductor components from failing at lower forces.

Applicants use the braids described herein in combination with the center conductors described herein to form the inventive cable. Cable stiffness is one parameter used to characterize the inventive cables. Cable stiffness is measured using the chord modulus of the cable. This chord modulus is defined by the slope of a chord on the stress-strain curve between an initial 2.0 lbf pre-load point and the point at which the electrical continuity of the cable is lost (see Equation 3 below).

Equation 3: Cable Chord Modulus $$\text{Cable Chord Modulus} = \frac{\Delta\sigma_r}{\varepsilon}$$

Where, $\Delta\sigma_r$=the change in relative stress of the center conductor $\in$=cable strain A relative stress is used in the stress-strain relationship to characterize the center conductor in the construction. The relative stress is calculated using the cable force as it relates to the cross-sectional area of the center conductor in the cable being tested (see Equation 4 below).

Equation 4: Relative Stress $$\sigma_r = \frac{\text{Cable Force (lbf)}}{\text{Center Conductor Area (in}^2\text{)}}$$

Although this is not the total cross-sectional area in tensile, it provides a relative value of cable stiffness per center conductor material and size. The braid angle can be used to control this chord modulus. Braid angle is defined as the angle between the longitudinal axis of the cable and the braid strand. A low braid angle indicates the braid strands are aligned more with the longitudinal axis of the cable. At a low braid angle very little extension is needed before the strands begin to contribute to the tensile strength of the cable structure. This produces a higher chord modulus. At a high braid angle the braid strands are aligned more perpendicular to the longitudinal axis and require greater extension before contributing to the tensile strength of the cable. This produces a lower chord modulus. For these small center conductors, required for low capacitance, it is important that the conductor is supported by a member that will increase the tensile stiffness of the cable. If the stiffness is too low, the center conductor will break in tensile before the rest of the cable construction properly shares the load.

Applicants have produced several samples demonstrating braid characteristics for the inventive cable. The details of the tests, the results, and the conclusions regarding these samples are presented in the Examples section below.

Examples of various embodiments of the present invention are presented hereafter. Associated tests used in the examples are presented immediately below. The examples are intended to illustrate the invention, but they are not intended to limit the invention to any particular embodiment. Rather, the applicants intend that the invention be given its full scope as defined in the appended claims.

II. Test Methods

A. Center Conductor Tensile Strength

Center conductor samples were tensile tested using an Instron 5565 tester equipped with Instron 2714-006 Cord & Yarn Grips. Samples where mounted with a gage length of 15 inches and pulled at a rate of 7.874 inch/min with a pre-load of 0.5 lbf.

B. Center Conductor Life

Figure 4:
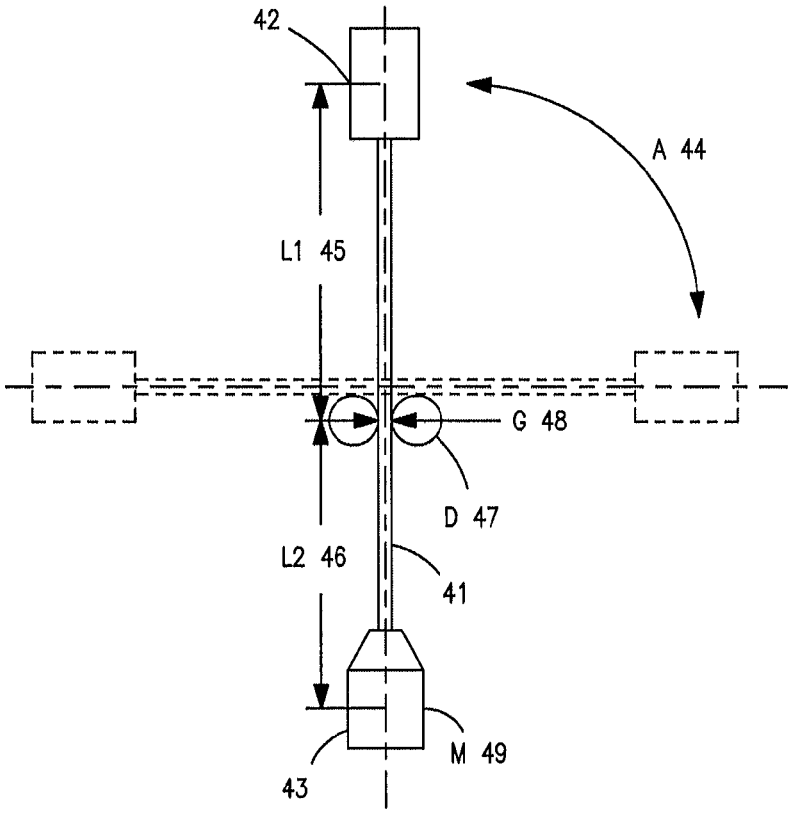
FIG. 4 is a schematic view of a flex test set-up.

Center conductor flex life was measured using a modified ASTM. B470-02 test. The test setup is illustrated in FIG. 4, where a load is applied to a sample (41) by attaching a weight (43) of mass "M" (49). The sample (41) is fed through two mandrels of diameter "D" (47) spaced apart by a gap "G" (48). The mandrels are set at a length "L2" (46) from the weight (43). A sample (41) is mounted in the clamp (42) at a length "L1" (45) from the mandrel gap "G" (48). The sample (41) is flexed above the mandrel gap "G" (48) at an angle "A" (44). One full flex cycle is counted after the sample has returned to the starting position. For +/−60 degrees, the sample travels 120 degrees in one direction and 120 degrees in the opposite direction before a full cycle is counted. The samples are flexed at a rate "R." Table 1 below sets forth the test parameters used in this setup.

TABLE 1.0

Center Conductor Flex Test Parameters

| Parameter | Symbol | Value |
|---|---|---|
| Rate (cycles/min) | R | 36 |
| Angle (deg) | A (44) | +/−60 |
| Fixed Length (in) | L1 (45) | 4.5 |
| Free Length (in) | L2 (46) | 16 |
| Mandrel Diameter (in) | D (47) | 0.0625/0.09375/0.1250[1] |
| Mandrel Gap (in) | G (48) | 0.0235/0.03125/0.0370[1] |
| Mass (lb) | M (49) | 0.88 |

[1]Values represent test conditions for AWG 28 (7/36 and 19/40), AWG 24 (7/32), and AWG 22 (19/34) respectively.

Conductor samples were mounted in the setup and flexed until mechanical failure of the conductor.

C. Cable Tensile Test

Samples were tested using an Instron 5565 Tester equipped with Qualitest THS185-50 Rope Grips. Samples where mounted with a gage length of 10 inches and pulled at a rate of 5.0 inch/min with a pre-load of 2.0 lbf. The center conductor continuity of each cable was monitored during testing and the force and extension at failure were noted. This allowed for comparison of braid failure versus center conductor failure. Tensile failure was determined to be the point where electrical continuity was lost.

D. Cable Capacitance Test

Cable capacitance was determined by measuring the overall cable assembly capacitance with a BK Precision 875B LCR Meter and test leads with alligator clips. Clips were attached to the center conductor and shield wires of the cable and capacitance for the entire cable was measured. This value was then divided by the cable length in feet to obtain a unit length capacitance of pF/ft.

E. Cable Flex Life

Cable flex life was measured using the same setup shown in FIG. 4, but with the following parameters:

Cable Flex Test Parameters

| Parameter | Symbol | Value |
|---|---|---|
| Rate (cycles/min) | R | 40 |
| Angle (deg) | A (44) | +/−90 |
| Fixed Length (in) | L1 (45) | 6.5 |
| Free Length (in) | L2 (46) | 19.7 |
| Mandrel Diameter (in) | D (47) | 1.5 |
| Mandrel Gap (in) | G (48) | Cable Diameter + .04 |
| Mass (lb) | M (49) | 3.0 |

Cable samples (41) were mounted in the setup and flexed until mechanical failure of the conductor or shield. Mechanical failure was determined by a 0.5 ohm increase in resistance across the conductor or shield.

III. Examples

A. Center Conductor Samples

Using the test methods described above for Center Conductor Tensile Strength and Center Conductor Flex Life, applicants measured the performance of a plurality of center conductors. The construction details of each center conductor and the test results are tabulated below in Table 1.

TABLE 1

Center Conductor Tensile Strength and Flex Life

| Sample | AWG | Conductor Cross-sectional Area ($10^{-4}$ in$^2$) | Material | Manufacturer | Re-inforcement | Average Peak Force (lbf) | Average Elongation (%) | Tensile Sample Size - n1 | Average Flex Life (Cycles to Failure) | Flex Sample Size - n2 |
|---|---|---|---|---|---|---|---|---|---|---|
| 1 | 22 (19/34) | 5.923 | Silver Plated Copper, Soft Temper | IWG High Performance Conductors, Inc. | N/A | 20.5 | 24.3 | 3 | 141 | 7 |
| 2 | 24 (7/32) | 3.475 | Silver Plated Copper, Soft Temper | IWG High Performance Conductors, Inc. | N/A | 12.3 | 23.9 | 3 | 83 | 3 |
| 3 | 28 (7/36) | 1.374 | Silver Plated Copper, Soft Temper | IWG High Performance Conductors, Inc. | N/A | 5.0 | 21.3 | 3 | 21 | 9 |
| 4 | 28 (19/40) | 1.471 | Silver Plated Copper, Soft Temper | IWG High Performance Conductors, Inc. | N/A | 4.9 | 23.7 | 3 | 20 | 6 |
| 5 | 28 (7/36) | 1.374 | Alloy 135 Tensile Flex ®, High Strength BeCu Copper Alloy, Soft Temper | IWG High Performance Conductors, Inc. | N/A | 9.3 | 8.4 | 3 | 74 | 12 |
| 6 | 28 (19/40) | 1.471 | Alloy 135 Tensile Flex ®, High Strength BeCu Copper Alloy, Soft Temper | IWG High Performance Conductors, Inc. | N/A | 9.0 | 10.7 | 3 | 99 | 6 |
| 7 | 28 (7/36) | 1.374 | CS95, High Strength BeCu Copper Alloy, Soft Temper | IWG High Performance Conductors, Inc. | N/A | 15.0 | 9.4 | 3 | 413 | 6 |
| 8 | 28 (7/36) | 1.374 | HS95, High Strength BeCu Copper Alloy, Soft Temper | Fisk Alloy Conductor, Inc. | N/A | 14.5 | 7.9 | 9 | 400 | 6 |
| 9 | 28 (7/36) | 1.374 | Alloy 135 Tensile Flex ®, High Strength BeCu Copper Alloy, Soft Temper | IWG High Performance Conductors, Inc. | ePTFE Tape 1, 1 Layer | 14.5 | 6.7 | 6 | 293 | 6 |
| 10 | 28 (7/36) | 1.374 | Alloy 135 Tensile Flex ®, High Strength BeCu Copper Alloy, Soft Temper | IWG High Performance Conductors, Inc. | ePTFE Tape 1, 2 Layer | 19.2 | 15.7 | 6 | 1427 | 7 |

TABLE 1-continued

Center Conductor Tensile Strength and Flex Life

| Sample | AWG | Conductor Cross-sectional Area ($10^{-4}$ in$^2$) | Material | Manufacturer | Re-inforcment | Average Peak Force (lbf) | Average Elongation (%) | Tensile Sample Size - n1 | Average Flex Life (Cycles to Failure) | Flex Sample Size - n2 |
|---|---|---|---|---|---|---|---|---|---|---|
| 11 | 28 (7/36) | 1.374 | Alloy 135 Tensile Flex ®, High Strength BeCu Copper Alloy, Soft Temper | IWG High Performance Conductors, Inc. | ePTFE Tape 2, 2 Layer | 21.2 | 15.9 | 6 | 819 | 6 |
| 12 | 28 (7/36) | 1.374 | Alloy 135 Tensile Flex ®, High Strength BeCu Copper Alloy, Soft Temper | IWG High Performance Conductors, Inc. | ePTFE Tape 3, 2 Layer | 20.3 | 22.6 | 6 | 1754 | 6 |
| 13 | 28 (7/36) | 1.374 | HS95, High Strength BeCu Copper Alloy, Soft Temper | Fisk Alloy Conductor, Inc. | ePTFE Tape 1, 2 Layer | 24.2 | 16.0 | 6 | 2046 | 6 |
| 14 | A28 (7/36) | 1.374 | HS95, High Strength BeCu Copper Alloy, Soft Temper | Fisk Alloy Conductor, Inc. | ePTFE Tape 2, 2 Layer | 26.2 | 14.6 | 6 | 2269 | 6 |
| 15 | 28 (7/36) | 1.374 | HS95, High Strength BeCu Copper Alloy, Soft Temper | Fisk Alloy Conductor, Inc. | ePTFE Tape 3, 2 Layer | 26.4 | 17.3 | 6 | 3747 | 6 |

The 22 AWG copper conductor (sample 1) tested is representative of a typical conductor type found in commercially available cables. Its peak force was observed to be 20.5 lb with 24% elongation. The 28 AWG copper conductor (sample 3) had a peak force of 5.0 lb with 21.3% elongation. The copper conductors have an ultimate tensile stress of about 30-35 ksi. The Alloy 135 is an alloy of beryllium and copper with an ultimate tensile stress of about 60 ksi (approximately twice that of the copper). The 28 AWG Alloy 135 samples increased the average peak force to 9.0-9.3 lbf with 8.4-10.7% elongation (samples 5 and 6). The HS95 and CS95 are similar alloys of beryllium and copper with ultimate tensile stress of about 90 ksi (approximately triple that of copper). HS95 and CS95 increased the peak force to 14.5-15.0 lb with 7.9-9.4% elongation (samples 7 and 8). The higher strength alloys (samples 5-8) have about 40% less elongation to failure than copper. By adding tape reinforcement to the high strength alloy conductors, tensile strength could be increased by an additional 10 lb. and elongation could be increased by 100% compared to the raw alloy (samples 9-15).

The 22 AWG copper conductor (sample 1) average flex life was observed to be 141 cycles. The 28 AWG copper conductor (sample 3) had an average flex life of 21 cycles. By using 28 AWG 60 ksi and 90 ksi alloy conductors, average flex life increased to 74-99 and 400-413 cycles respectively (samples 5-8). The 28 AWG 90 ksi alloy conductors (samples 7 and 8) exhibit an average flex life about 20 times that of 28 AWG copper (samples 3 and 4) almost 3 times that of 22 AWG copper (sample 1), and almost 5 times that of 24 AWG copper (sample 2). By adding various forms of tape reinforcement to the 28 AWG 90 ksi alloy conductor (samples 13-15) average flex life could be further increased to 2046-3747 cycles or about 97 to 178 times that of 28 AWG copper conductor (sample 3).

B. Braid Samples

Cables were constructed having varying braid angles. Table 2 below sets forth the cable construction. These cable parameters were held constant while the braid angle was varied. The cables were tested for tensile properties according to the tensile test set forth above. The results of the tests are also set forth in Table 3.

TABLE 2

Braid Example Cable Definitions

| Center Conductor | Dielectric | Semi-Con-ductive Layer | Shield | Binder | Jacket |
|---|---|---|---|---|---|
| AWG 28 (7/36) Bare Copper Soft temper | Foamed PE, Diameter: 0.161" Nom. | PE, Diameter: 0.165" Nom. | AWG 38 (1) TPC Braid, 16 Carrier, 8 Ends, (see Table 5.1 for angle) | 0.002" Nom. Wall Conductive ePTFE | 0.065" Nom. Wall PVC |

TABLE 3

Braid Example Tensile Results

| Sample Number | Center Conductor Cross-sectional Area ($10^{-4}$ in$^2$) | Braid Angle (Degrees) | Relative Stress at Failure (ksi) | Cable Strain at Failure (%) | Chord Modulus (ksi) | Cable Force at Failure (lbf) | Failure Mode |
|---|---|---|---|---|---|---|---|
| 3580_2_S1 | 1.374 | 38.8 | 157 | 18.7 | 763 | 21.6 | Center Conductor |
| 3580_2_S2 | 1.374 | 20.8 | 584 | 48.0 | 1,187 | 80.3 | Center Conductor |
| 3580_2_S3 | 1.374 | 9.6 | 615 | 44.9 | 1,339 | 84.6 | Shield |

Figure 5:
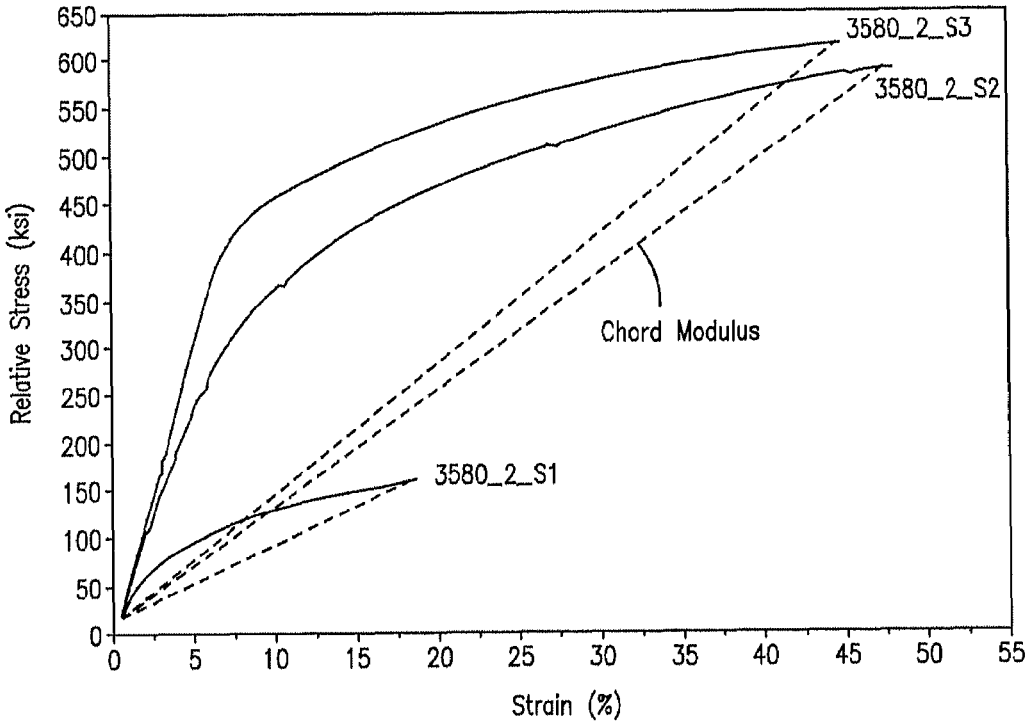
FIG. 5 is a stress-strain graph for cables according to exemplary embodiments of the present invention.
Figure 6:
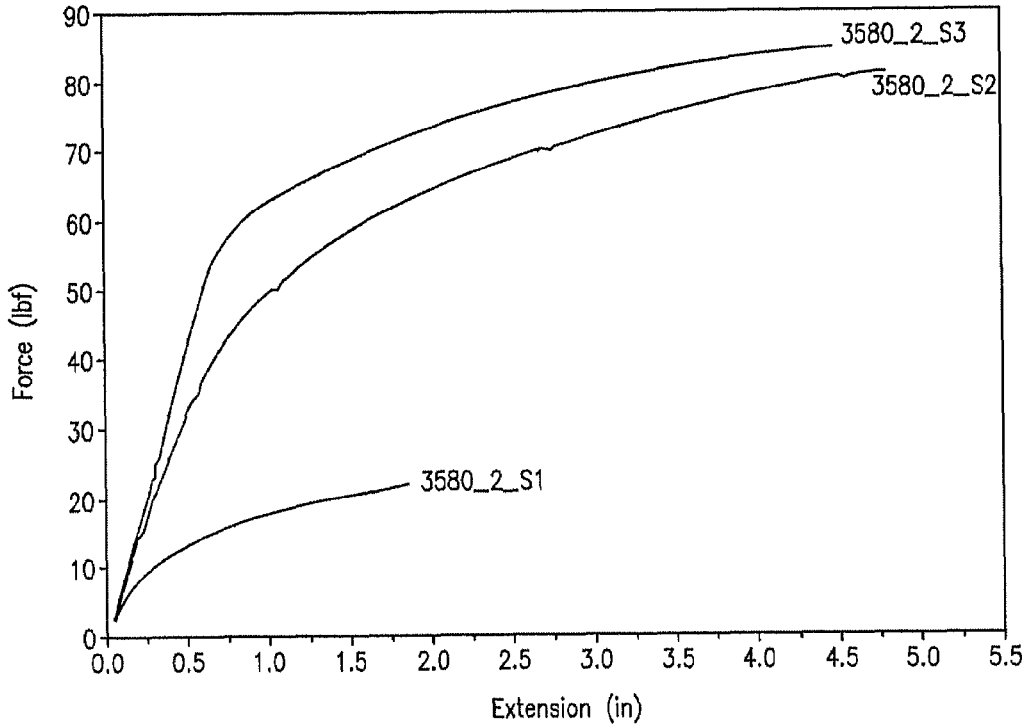
FIG. 6 is a force-extension graph for cables according to exemplary embodiments of the present invention.

Table 3 shows the cable force and extension where continuity was lost for the three different braid angles. Also noted on this chart is the failure mode which describes the first mechanical component of the system to experience tensile failure. The center conductor in Sample 3580_2_S1 fails at a significantly lower force and extension than the braid. This translates into a significantly lower force at failure compared to the other two samples. As the braid angle is decreased in samples 2 and 3 respectively, the relative stress increases and the chord modulus increases as the braid contributes tensile strength at a faster rate as a function of strain (FIG. 5). This preserves the center conductor and results in a higher cable force at failure (FIG. 6). This learning can be translated to other cable constructions by controlling braid angle.

C. Working Examples of the Inventive Cable

Cables according to the present invention were made with various constructions as shown in Table 4 below. The dielectric, semi-conductive layer and jacket were held constant and are the same as defined in Table 2. For each construction, the shield (14) is a braid made with AWG 38(1) tin-plated copper wire. An average braid diameter ($D_{ave}$) of approximately 0.173 inches was constructed for each example. The shield effective inner diameter for each example is approximately 0.171 inches. All of the center conductors are AWG 28(7/36), having an effective outer diameter of approximately 0.0142 inches to achieve low capacitance values.

TABLE 4

Working Examples Description

| | | Braided Shield Parameters (FIG. 3) | | | | |
|---|---|---|---|---|---|---|
| Example | Center Conductor | Carriers (m) | Ends (E) (total in braid) | Picks per Inch (Q) | Angle (α) | Binder |
| 8730_19 | Silver-Plated HS95 Soft Temper | 24 | 8 (192) | 19 | 41° | None |
| 8730_12 | Silver-Plated HS95 Soft Temper | 24 | 8 (192) | 12 | 29° | None |
| 8730_9 | Silver-Plated HS95 Soft Temper | 24 | 8 (192) | 9 | 22° | None |
| 3580_3 | Silver-Plated CS95 Soft Temper | 16 | 8 (128) | 9 | 31° | 0.002" Nom. Wall Conductive ePTFE |
| 3590_1 | Bare Copper Soft Temper | 16 | 8 (128) | 9 | 31° | 0.002" Nom. Wall Conductive ePTFE |
| 3591_1 | Silver-Plated CS95 Soft Temper | 24 | 8 (192) | 9 | 22° | 0.002" Nom. Wall Conductive ePTFE |
| 3592_1 | Silver-Plated CS95 Soft Temper | 24 | 8 (192) | 6 | 15° | 0.002" Nom. Wall Conductive ePTFE |
| 3593_1 | Silver-Plated CS95 Soft Temper | 24 | 8 (192) | 4 | 10° | 0.002" Nom. Wall Conductive ePTFE |

All cable constructions outlined in Table 4 were tested for capacitance according to the procedure set forth above. For comparison, the following commercially available cables were also tested: PlanetWaves™ PW-AG-15, ProCo SEG-10, Monster® Cables Monster Rock™, Horizon HCS-25. All of the results are presented below in Table 5.

TABLE 5

Cable Capacitance Values

| Model | Measured Capacitance (pF/ft) |
|---|---|
| 8730_19 | 10.1 |
| 8730_12 | 10.1 |
| 8730_9 | 10.1 |
| 3580_3 | 10.0 |
| 3590_1 | 10.0 |
| 3591_1 | 10.0 |
| 3592_1 | 10.0 |
| 3593_1 | 10.0 |
| PW-AG-15 | 18.0 |
| SEG-10 | 36.1 |
| Monster Rock | 41.9 |
| HCS-25 | 24.5 |

Capacitance results for cable show all exemplary embodiments have capacitances less than or equal to 10.1 pF/ft. This was achieved by an effective diameter ratio of approximately 12 and a foamed PE dielectric of about 1.5. The closest commercially available option tested, the PW-AG-15, had a capacitance of 18 pF/ft. The other cables ranged from 24.6 (HCS-25) to 42.6 (Monster Rock) pF/ft. Because the capacitance of the inventive cables is so low, the resulting tone quality is far superior to that of the comparative samples.

Next, all the exemplary cables and the comparative cables were tested for tensile strength and cable flex life according to the procedures outlined above. The center conductor cross-sectional area (A) was measured for each sample. Relative stress at failure (B) and chord modulus (D) was calculated based upon the measured values for cable strain at failure (C) and cable force at failure (E). For some of the models, three samples were tested for cable flex life (F). The results are shown in Table 6.1.

TABLE 6.1

Cable Tensile and Flex Results

| Sample Number | Model Number | (A) Center Conductor Cross-sectional Area ($10^{-4}$ in$^2$) | (B) Relative Stress at Failure (ksi) | (C) Cable Strain at Failure (%) | (D) Chord Modulus (ksi) | (E) Cable Force at Failure (lbf) | (F) Cable Flex Life (Cycles to Failure) |
|---|---|---|---|---|---|---|---|
| 1 | 8730_19 | 1.374 | 471 | 33.4 | 1,368 | 64.8 | N/A |
| 2 | 8730_12 | 1.374 | 716 | 32.7 | 2,144 | 98.4 | N/A |
| 3 | 8730_9 | 1.374 | 776 | 29.4 | 2,591 | 106.7 | N/A |
| 4 | CXN3580_3 | 1.374 | 594 | 31.4 | 1,847 | 81.7 | >333,912 |
| | | | | | | | 166,681 |
| | | | | | | | >333,912 |
| 5 | CXN3590_1 | 1.374 | 596 | 53.5 | 1,087 | 81.9 | 1,961 |
| | | | | | | | 1,838 |
| | | | | | | | 1,716 |
| 6 | CXN3591_1 | 1.374 | 839 | 31.9 | 2,580 | 115.3 | >218,512 |
| | | | | | | | >218,512 |
| | | | | | | | >218,512 |
| 7 | CXN3592_1 | 1.374 | 878 | 26.1 | 3,304 | 120.7 | 40,913 |
| | | | | | | | 59,787 |
| | | | | | | | 38,697 |
| 8 | CXN3593_1 | 1.374 | 891 | 28.9 | 3,031 | 122.4 | 41,500 |
| | | | | | | | 31,156 |
| | | | | | | | 45,144 |
| 9 | Planet Waves PW-AG-15 | 3.470 | 269 | 47.4 | 555 | 93.3 | 21,880 |
| | | | | | | | 30,630 |
| | | | | | | | 35,950 |
| 10 | ProCo StageMaster SEG-10 | 3.181 | 212 | 41.0 | 503 | 67.5 | 40,500 |
| | | | | | | | 26,500 |
| | | | | | | | 28,500 |
| 11 | Monster Rock | 10.238 | 102 | 63.3 | 158 | 104.5 | N/A |
| 12 | Horizon HCS-25 | 3.438 | 188 | 64.7 | 282 | 64.8 | N/A |

Of particular note, are samples 4 and 5. These two samples have identical construction except for the use of a copper center conductor in sample and an alloy center conductor in sample 4. Both cables exhibit peak forces of around 80 lbs, indicating that the braid construction is supporting the center conductors. The cable made with the lower elongation copper alloy center conductor produces a cable with lower strain at failure. This requires a higher chord modulus to maintain the same peak force of the cable made with the same size copper center conductor. The commercial comparisons incorporate larger center conductors which can achieve a higher peak force at a lower chord modulus. The chord modulus for the commercial comparisons is lower due to the increased cross-sectional area of the larger center conductors (more than twice that of the AWG 28(7/36) conductor). The larger center conductors provide more strength and require less support from the rest of the cable to achieve higher peak forces. However, these larger center conductors produce cables with higher capacitance based upon shield diameters and dielectric materials commonly used for instrument cables.

All of the low capacitance examples meet or exceed the tensile strength of the commercial cables tested despite the significant reduction in center conductor size.

Examining flex life shows that the standard copper center conductor of sample 5 lasted only 1,838 cycles in flex while sample 4 lasted a minimum of 166,681 cycles with two samples never failing within the 333,912 cycle duration of the test. Sample 6 with alloy center conductor was also removed at end of test (218,512 cycles) before a failure was detected.

All the cables with alloy center conductors exceeded in average flex performance compared to the commercially available cables tested.

While the present invention has been illustrated with reference to certain preferred embodiments, it is not intended to be limited thereto. Rather, the invention is to be given the full scope of the appended claims.

The invention claimed is:

1. A cable comprising (a) a center conductor having an effective outer diameter;

(b) a dielectric material around said center conductor;

(c) an outer conductor, or shield, around said dielectric material; said shield having an effective inner diameter;

(d) wherein said center conductor has a cross-sectional area of $3.141\times10^{-4}$ in$^2$ or less;

(e) wherein the cable has a capacitance of about 15 pF/ft or less;

(f) wherein the cable maintains electrical continuity under a tensile force of 25 lbf or greater;

(g) wherein the cable has a flex life of greater than about 30,000 cycles; and (h) wherein said cable is a musical instrument cable.

2. A cable as defined in claim 1 wherein said center conductor has a cross-sectional area of $1.767\times10^{-4}$ in$^2$ or less.

3. A cable as defined in claim 1 wherein said center conductor comprises copper.

4. A cable as defined in claim 1 wherein said center conductor comprises copper that has tensile strengths greater than about 35 ksi.

5. A cable as defined in claim 1 wherein said center conductor comprises an alloy.

6. A cable as defined in claim 1 wherein said center conductor comprises an alloy of beryllium and copper.

7. A cable as defined in claim 1 wherein said shield is a braid where the strands are at an angle less than 40 degrees from the axis of the braid.

8. A cable as defined in claim 1 wherein a ratio of said shield effective inner diameter to said center conductor effective outer diameter is greater than about 8.

9. A cable as defined in claim 1 wherein a ratio of said shield effective inner diameter to said center conductor effective outer diameter is greater than about 10.

10. A cable as defined in claim 1 wherein a ratio of said shield effective inner diameter to said center conductor effective outer diameter is greater than about 12.

11. A cable as defined in claim 1 wherein said capacitance is about 12 pF/ft or less.

12. A cable as defined in claim 1 wherein said capacitance is about 10 pF/ft or less.

13. A cable as defined in claim 1 wherein cable maintains electrical continuity under a tensile force of about 50 lbf or greater.

14. A cable as defined in claim 1 wherein cable maintains electrical continuity under a tensile force of about 100 lbf or greater.

15. A cable as defined in claim 1 wherein said flex life is greater than about 150,000 cycles.

16. A cable as defined in claim 1 wherein said flex life is about 275,000 cycles.

17. A cable as defined in claim 1 wherein said musical instrument comprises a passive magnetic pickup.

18. A cable as defined in claim 17 wherein said musical instrument is a stringed instrument.

19. A cable as defined in claim 18 wherein said center conductor comprises an alloy of beryllium and copper and has a cross-sectional area of $1.767\times10^{-4}$ in$^2$ or less; a ratio of said shield effective inner diameter to said center conductor effective outer diameter is greater than about 8; said capacitance is about 10 pF/ft; said tensile strength is about 100 lbf; and said flex life is about 275,000 cycles.

20. An article comprising the cable of claim 19 in combination with a passive magnetic pick-up.

21. An article as defined in claim 20 further comprising a stringed musical instrument comprising said passive magnetic pickup.

22. An article comprising the cable of claim 1 in combination with a passive magnetic pick-up.

23. An article as defined in claim 22 further comprising a stringed musical instrument comprising said passive magnetic pickup.

24. A cable comprising:

(a) a center conductor having an outer effective diameter;

(b) a reinforcement layer around said center conductor;

(c) a dielectric material around said polymer reinforcement;

(d) an outer conductor, or shield, around said dielectric material; said shield having an inner effective diameter;

(e) wherein said center conductor has a cross-sectional area of $3.141\times10^{-4}$ in$^2$ or less;

(f) wherein the cable has a capacitance of about 15 pF/ft or less;

(g) wherein the cable maintains electrical continuity under a tensile force of 25 lbf or greater.

(h) wherein the cable has a flex life of greater than about 30,000 cycles; and (i) wherein said cable is a musical instrument cable.

25. A cable as defined in claim 24 wherein said reinforcement layer comprises ePTFE.

26. A cable as defined in claim 24 wherein said reinforcement layer is selected from the group consisting of fluoropolymers, thermosetting or thermoplastic polymers, cellulose-based materials or metallic foils.

27. A cable comprising (a) a center conductor;

(b) a non-metallic strength fiber contacting said center conductor;

(c) a dielectric material around said center conductor;

(d) an outer conductor, or shield, around said dielectric material; wherein said center conductor has a cross-sectional area of $3.141\times10^{-4}$ $in^2$ or less;

(e) wherein the cable has a capacitance of about 15 pF/ft or less;

(f) wherein the cable maintains electrical continuity under a tensile force of 25 lbf or greater;

(g) wherein the cable has a flex life of greater than about 30,000 cycles; and (h) wherein said cable is a musical instrument cable.

28. A cable comprising (a) a center conductor;

(b) a strength fiber not contacting said center conductor;

(c) a dielectric material around said center conductor;

(d) an outer conductor, or shield, around said dielectric material; wherein said center conductor has a cross-sectional area of $3.141\times10^{-4}$ $in^2$ or less;

(e) wherein the cable has a capacitance of about 15 pF/ft or less;

(f) wherein the cable maintains electrical continuity under a tensile force of 25 lbf or greater;

(g) wherein the cable has a flex life of greater than about 30,000 cycles; and (h) wherein said cable is a musical instrument cable.

* * * * *